US009139018B2

(12) United States Patent
Aihara et al.

(10) Patent No.: US 9,139,018 B2
(45) Date of Patent: Sep. 22, 2015

(54) PRINTING APPARATUS AND PRINTING METHOD

(71) Applicants: Yuichi Aihara, Yamanashi-ken (JP); Hiroshi Mochizuki, Yamanashi-ken (JP); Toshiro Fujimoto, Yamanashi-ken (JP); Kota Hihara, Yamanashi-ken (JP)

(72) Inventors: Yuichi Aihara, Yamanashi-ken (JP); Hiroshi Mochizuki, Yamanashi-ken (JP); Toshiro Fujimoto, Yamanashi-ken (JP); Kota Hihara, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/293,437

(22) Filed: Jun. 2, 2014

(65) Prior Publication Data

US 2014/0354752 A1 Dec. 4, 2014

(30) Foreign Application Priority Data

Jun. 3, 2013 (JP) ..... 2013-116846
Jun. 3, 2013 (JP) ..... 2013-116847
May 16, 2014 (JP) ..... 2014-102129

(51) Int. Cl.
*B41J 2/165* (2006.01)
*B41J 2/325* (2006.01)

(52) U.S. Cl.
CPC ..... *B41J 2/325* (2013.01)

(58) Field of Classification Search
None
See application file for complete search history.

(56) References Cited

FOREIGN PATENT DOCUMENTS

JP 2008-207375 A 9/2008
JP 2009-154540 A 7/2009

*Primary Examiner* — Alejandro Valencia
(74) *Attorney, Agent, or Firm* — Manabu Kanesaka

(57) ABSTRACT

To provide a printing apparatus without waste of a ribbon panel in using a two-side dedicated ribbon, a printing apparatus 1 capable of printing on both surfaces of a printing medium performs two-side printing using an ink ribbon 41 with a color ribbon panel 41*a* and monochrome ribbon panel 41*b* configured in a face sequential manner. At this point, the apparatus detects a position of each ribbon panel, judges a type (color or monochrome) of a next usable nearest ribbon panel of the ink ribbon 41, judges which type of the ribbon panel (color or monochrome) is used for printing data sent from a higher apparatus 201, and compares the type of the next usable nearest ribbon panel with the ribbon panel judged with the printing data to determine the printing order on the printing medium.

6 Claims, 12 Drawing Sheets

PRINTING APPARATUS AND PRINTING METHOD

TECHNICAL FIELD

The present invention relates to a printing apparatus, and more particularly, to a printing apparatus that performs printing processing on a printing medium with a thermal head via an ink ribbon.

BACKGROUND ART

Conventionally, such a printing apparatus has been known widely that forms an image such as a photograph of face and character information on a printing medium (hereinafter, referred to as a card) such as a plastic card. In such a printing apparatus, an indirect printing scheme is used in which an image (mirror image) is formed on a transfer film (recording medium) with a thermal head via an ink ribbon, and next the image formed on the transfer film is transferred to a printing medium.

An ink ribbon used in this type of printing apparatus is comprised of color ribbon panels of Y (Yellow), M (Magenta), C (Cyan), Bk (Black) and the like in a face sequential manner, and by overlaying each color, it is possible to perform color printing. In this case, it is known that a color image such as a photograph of face is printed with YMC and that a monochrome image such as text is printed with Bk. Further, in the case of printing on both card surfaces, the card is reversed after printing on the frontside of the card, and then, printing processing is applied to the card backside.

PRIOR ART DOCUMENT

Patent Document 1: Japanese Patent Application Publication No. 2008-207375 (see FIG. 2)

DISCLOSURE OF INVENTION

Problems to be Solved by the Invention

In the printing apparatus as described above, it often happens that color data (photograph of face and the like) and monochrome data (text and the like) is printed on the frontside of the card, and that only monochrome data (text and the like) is printed on the backside. In such a case, as shown in FIG. 11, when printing is performed using a two-side printing dedicated ink ribbon 41 in which a color ribbon panel 41*a* comprised of Y (Yellow), M (Magenta), C (Cyan) and Bk (Black) for the frontside and a monochrome ribbon panel 41*b* comprised of Bk (Black) for the backside are arranged continuously and the color ribbon panel 41*a* and monochrome ribbon panel 41*b* are configured in a face sequential manner, the YMC portion is not wasted in backside printing.

There is no problem in the case of always printing colors on the frontside of the card, and printing a monochrome on the backside. However, in the case of printing a monochrome on the frontside of the card, and printing colors on the backside during the time of issuing a plurality of cards, printing is started with the monochrome ribbon panel 41*b* for the backside while passing the color ribbon panel 41*a* for the frontside, printing on the backside of the card is then performed with the next color ribbon panel 41*a* for the frontside, and therefore, there is the problem that the previous color ribbon panel 41*a* is wasted.

In view of the above-mentioned matter, it is an object of the present invention to provide a printing apparatus that does waste a ribbon panel in using a two-side dedicated ribbon.

Means for Solving the Problem

To attain the above-mentioned object, the present invention is characterized in that a printing apparatus, which performs printing processing directly or indirectly on a printing medium using an ink ribbon in which a first ribbon panel of a single color or a plurality of colors and a second ribbon panel of a type different from the first ribbon panel are continuously arranged and the first ribbon panel and the second ribbon panel are arranged in a face sequential manner to print on both surfaces of the printing medium having a first surface and a second surface, is provided with a printing section that forms an image directly or indirectly on the printing medium, a detecting device for detecting a panel position of each ribbon panel of the ink ribbon, an use panel judging device for judging whether a next usable nearest ribbon panel is the first ribbon panel or the second ribbon panel from a detection result by the detecting device, a receiving section that receives printing data, a printing data judging device for judging whether the printing data is printed using the first ribbon panel or is printed using the second ribbon panel, and a printing order determining device for determining a printing order on the first surface and the second surface of the printing medium, and that the printing order determining device compares a type of the next usable nearest ribbon panel judged by the use panel judging device with a type of the ribbon panel judged by the printing data judging device to determine the printing order on the first surface and the second surface of the printing medium.

In addition, the printing order determining device is configured to be able to further change the printing order corresponding to whether the first surface of the printing medium is discharged with the surface up or is discharged with the surface down, and is characterized by determining the printing order corresponding to the discharge surface of the printing medium when the printing data judging device judges that the same type of ink panels are used for the first surface and the second surface of the printing medium.

Further, a printing method of the present invention is a printing method for performing printing processing directly or indirectly on a printing medium using an ink ribbon in which a first ribbon panel of a single color or a plurality of colors and a second ribbon panel of a type different from the first ribbon panel are continuously arranged and the first ribbon panel and the second ribbon panel are arranged in a face sequential manner to print on both surfaces of the printing medium having a first surface and a second surface, and is characterized by detecting a panel position of each ribbon panel of the ink ribbon, judging whether a next usable nearest ribbon panel is the first ribbon panel or the second ribbon panel, judging whether printing data is printed using the first ribbon panel or is printed using the second ribbon panel, comparing a type of the next usable nearest ribbon panel with a type of the ribbon panel judged with the printing data to determine a printing order on the first surface and the second surface of the printing medium, and performing printing processing on both surfaces of the printing medium according to the determined printing order.

Advantageous Effect of the Invention

According to the present invention, in using a two-side dedicated ribbon to print on both surfaces of printing media, it is possible to obtain the effect for enabling waste of an ink panel to be eliminated by comparing the type of a next usable ribbon panel with the type of printing data to determine the printing order of the first surface and the second surface of each of printing media.

BRIEF DESCRIPTION OF DRAWINGS

FIG. 10A illustrates the time of normal processing before detecting near empty, and FIG. 10B illustrates the time of near empty processing after detecting near empty;

FIG. 11A shows a two-side dedicate ribbon with different types of ribbon panels arranged in a face sequential manner, and FIG. 11B shows an ink ribbon with the same type of ribbon panels arranged in a face sequential manner.

MODE FOR CARRYING OUT THE INVENTION

With reference to drawings, described below is an Embodiment in which the present invention is applied to a printing apparatus for printing and recording text and image on a card, while performing magnetic or electric information recording on the card.

<System Configuration>

Figure 1:
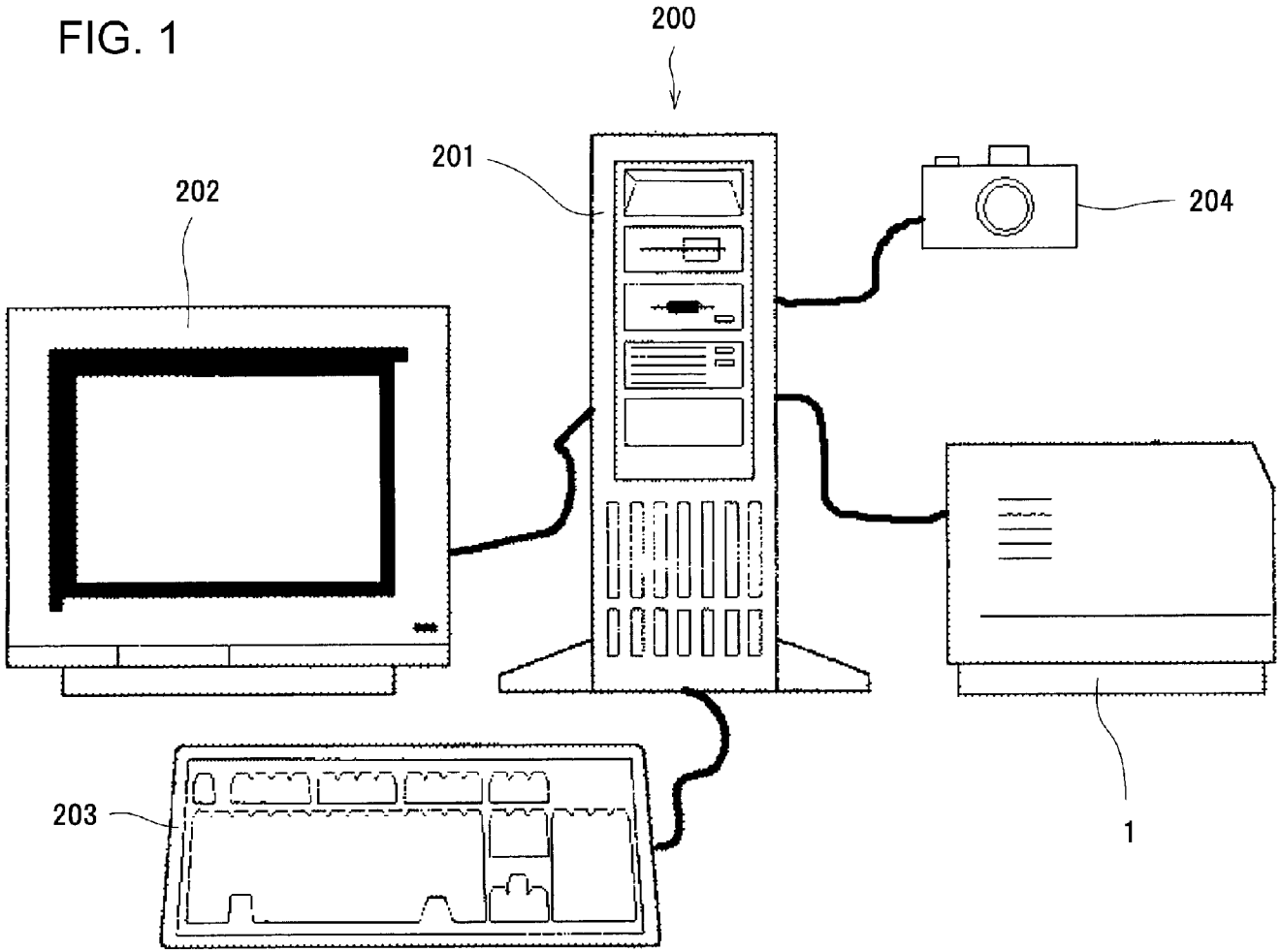
FIG. 1 is an outside view of a printing system including a printing apparatus of an Embodiment to which the present invention is applicable.
Figure 8:
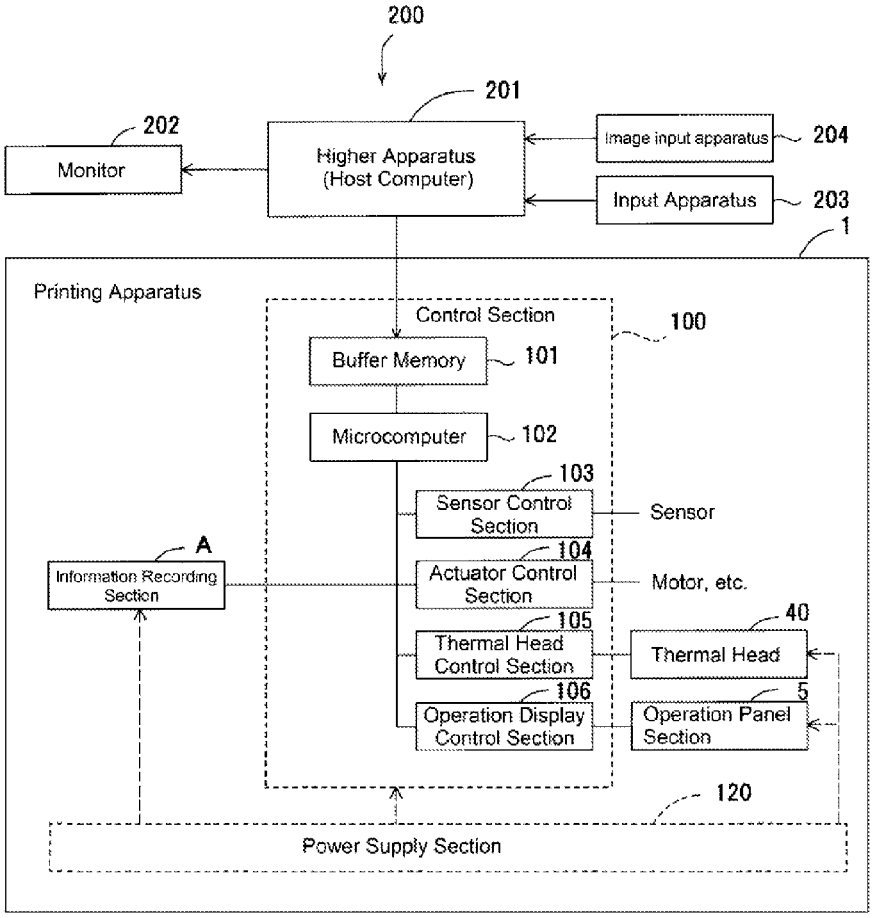
FIG. 8 is a block diagram illustrating a schematic configuration of a control section in the printing apparatus of the Embodiment.

As shown in FIGS. 1 and 8, a printing apparatus 1 of this Embodiment constitutes apart of a printing system 200. In other words, the printing system 200 is broadly comprised of a higher apparatus 201 (for example, host computer such as a personal computer) and the printing apparatus 1.

The printing apparatus 1 is connected to the higher apparatus 201 via an interface with the figure omitted, and the higher apparatus 201 is capable of transmitting printing data, magnetic or electric recording data and the like to the printing apparatus 1 to indicate recording operation and the like. In addition, the printing apparatus 1 has an operation panel section (operation display section) 5 (see FIG. 8), and as well as recording operation indication from the higher apparatus 201, recording operation is also capable of being indicated from the operation panel section 5.

The higher apparatus 201 is generally connected to an image input apparatus 204 such as a digital camera and scanner, an input apparatus 203 such as a keyboard and mouse to input commands and data to the higher apparatus 201, and a monitor 202 such as a liquid crystal display to display data and the like generated in the higher apparatus 201.

<Printing Apparatus>

Figure 2:
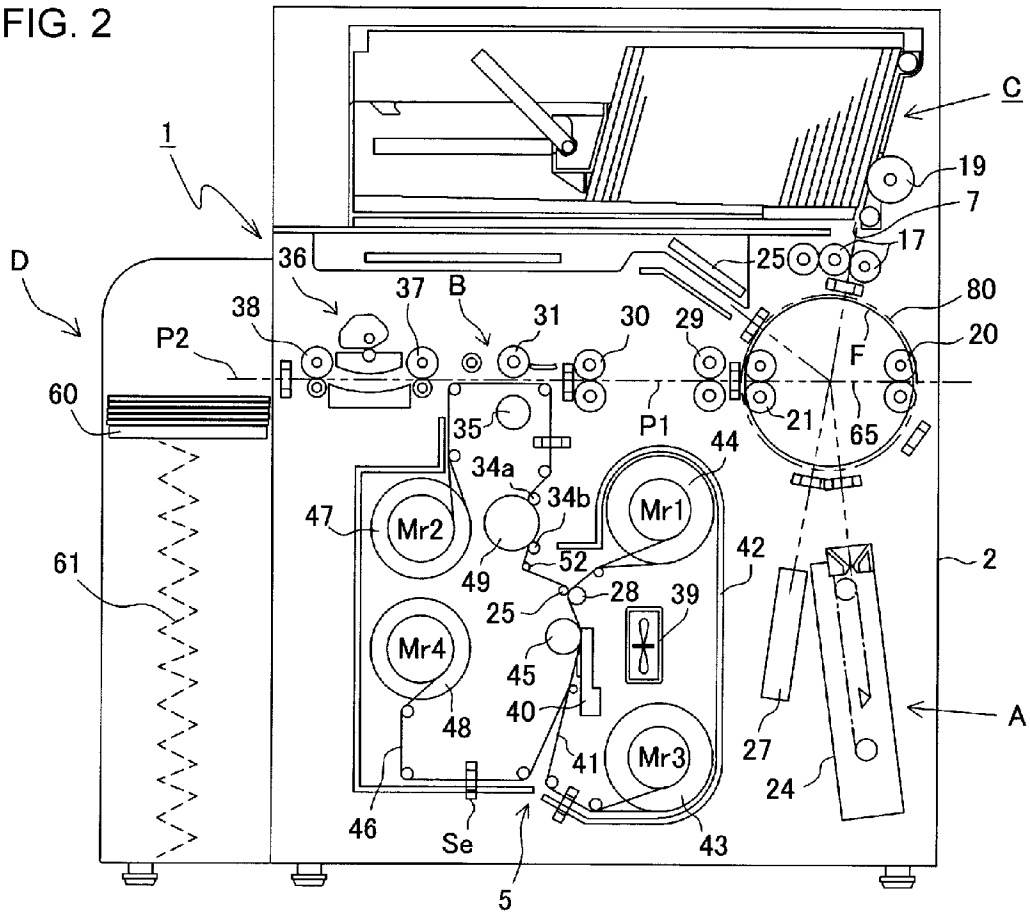
FIG. 2 is a schematic configuration view of the printing apparatus of the Embodiment.

As shown in FIG. 2, the printing apparatus 1 has a housing 2, and the housing 2 is provided with an information recording section A, image formation section B, media storage section C and storage section D.

The information recording section A is comprised of a magnetic recording section 24, non-contact type IC recording section 23, and contact type IC recording section 27.

The media storage section C aligns and stores a plurality of cards in a standing posture, is provided at its front end with a separation opening 7, and feeds and supplies starting with the card in the front row with a pickup roller 19.

The fed card is first sent to a reverse unit F with carry-in rollers 22. The reverse unit F is comprised of a rotating frame 80 bearing-supported by the housing 2 to be turnable, and two roller pairs 20, 21 supported on the frame. Then, the roller pairs 20, 21 are axially supported by the rotating frame 80 to be rotatable.

Around the reverse unit F in the turn direction are disposed the magnetic recording section 24, non-contact type IC recording section 23, and contact type IC recording section 27. Then, the roller pairs 20, 21 form a medium carry-in path 65 for carrying in toward one of the information recording sections 23, 24 and 27, and data is magnetically or electrically written on the card in the recording sections.

The image formation section B is to form an image such as a photograph of face and text data on frontside and backside of the card, and a medium transport path P1 for carrying the card is provided on an extension of the medium carry-in path 65. Further, in the medium transport path P1 are disposed transport rollers 29, 30 that transport the card, and the rollers are coupled to a transport motor not shown.

The image formation section B is provided with a film-shaped medium transport apparatus, a first transfer section that first prints an image, with a thermal head 40, on a transfer film 46 transported with the transport apparatus, and a second transfer section that subsequently prints the image printed on the transfer film 46 on the frontside of the card existing in the medium transport path P1 with a heat roller 33.

On the downstream side of the image formation section B is provided a medium transport path P2 for carrying the printed card to a storage stacker 60. In the medium transport path P2 are disposed transport rollers 37, 38 that transport the card, and the rollers are coupled to a transport motor not shown.

A decurl mechanism 36 is disposed in between the transport roller 37 and the transport roller 38, presses the card center portion held between the transport rollers 37, 38, and thereby corrects curl generated by thermal transfer with the heat roller 33. Therefore, the decurl mechanism 36 is configured to be able to shift to positions in the vertical direction as viewed in FIG. 2 by an up-and-down mechanism such as a cam not shown.

The storage section D is configured to store cards sent from the image formation section B in the storage stacker 60. The storage stacker 60 is configured to shift downward in FIG. 2 with an up-and-down mechanism 61.

The image formation section B in the entire configuration of the above-mentioned printing apparatus 1 will be further described specifically.

The transfer film 46 is wound around each of a wind-up roll 47 and feed roll 48 of a transfer film cassette rotated by driving motors Mr2 and Mr4. A film transport roller 49 is a main driving roller for carrying the transfer film 46, and a transport amount and transport halt position of the transfer film 46 are determined by controlling driving of the roller 49. The film transport roller 49 is coupled to a stepping motor not shown. The motor Mr2 is also driven at the time of driving the film transport roller 49, is for the wind-up roll 47 to reel the fed transfer film 46, and is not driven as main transport of the transfer film 46. In addition, the feed roll 48 is coupled to the motor Mr4, and when the transfer film 46 is transported in the direction of being wound around the wind-up roll 47, the rotation speed of the motor Mr4 is controlled to provide the transfer film 46 with moderate back tension.

Pinch rollers 32*a* and 32*b* are disposed on the periphery of the film transport roller 49. Although not shown in FIG. 2, the pinch rollers 32*a* and 32*b* are configured to be movable to move and retract with respect to the film transport roller 49, and in a state in the figure, the rollers move to the film transport roller 49 to come into press-contact, and thereby wind the transfer film 46 around the film transport roller 49. By this means, the transfer film 46 undergoes accurate transport by a distance corresponding to the number of revolutions of the film transport roller 49.

Figure 10B:
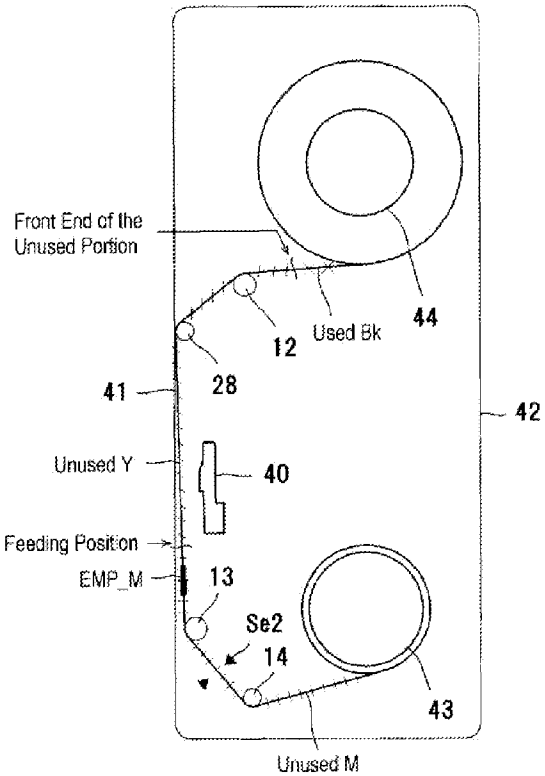
FIGS. 10A and 10B contain explanatory views schematically showing the relationship between a sensor for detecting an ink ribbon and an empty mark, viewed from the arrow A side of FIG. 6, where

An ink ribbon 41 is stored in an ink ribbon cassette 42, a supply spool 43 for supplying the ink ribbon 41 and wind-up spool 44 for winding the ink ribbon 41 are stored in the cassette 42, the wind-up spool 44 is driven with a motor Mr1, and the supply spool 43 is driven with a motor Mr3. Forward-backward rotatable DC motors are used for the motors Mr1 and Mr3. Further, "Se2" shown in FIG. 2 denotes a transmission sensor to detect an empty mark (see reference mark EMP_M in FIG. 10B) indicative of a use limit of the ink ribbon 41 attached to the end portion of the ink ribbon 41.

Figure 11A:
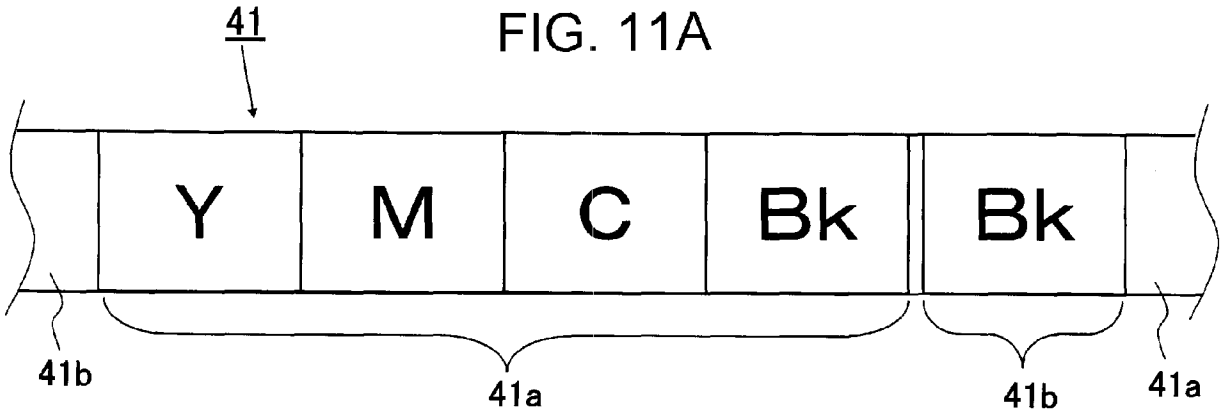
FIGS. 11A and 11B contain views illustrating ink ribbons used in the printing apparatus of the Embodiment, where

In addition, the ink ribbon 41 is a two-side dedicated ribbon, and is configured by repeating a ribbon panel of Y (Yellow), M (Magenta), C (Cyan) and Bk (Black) that is a color ribbon panel for card frontside (first surface) printing and a ribbon panel of Bk (Black) that is a monochrome panel for backside (second surface) printing in a face sequential manner (see FIG. 11A). The ink ribbon 41 is to print a color image such as a photograph of face on the frontside (first surface), and print a monochrome image such as text on the backside (second surface). Accordingly, using Y, M, C, Bk and Bk, printing is performed on a single card. In addition, the two-side dedicated ribbon is an ink ribbon configured so that different types of ribbon panels (Y, M, C, Bk: Bk, Y, M, C, Bk, Hs: Bk, Hs (Hs is a heat seal) and the like) are arranged continuously, and are arranged in a face sequential manner. Accordingly, card two-side printing is performed by printing on the first surface of the card using the first type of ribbon panel, and printing on the second surface of the card using the second type of ribbon panel.

Further, in the case of performing color printing on card both surfaces, printing is performed using the ink ribbon (see FIG. 11B) with the same type of ribbon panels (with Y (Yellow), M (Magenta), C (Cyan) and Bk (Black) as a single set) configured in a face sequential manner. In the case of performing monochrome printing on the both surfaces, an ink ribbon (not shown) comprised of only Bk (Black) is used.

In the printing apparatus 1 of this Embodiment, it is possible to perform printing processing using a plurality of types of ink ribbons 41 as described above, and therefore, it is necessary to judge the type of ink ribbon 41. It may be judged by installing IC chips in the ink ribbons to perform communications with the printing apparatus 1, or a user may input the type of ink ribbon 41 to set. Further, the type of ink ribbon 41 may be judged from a result obtained by adding a mark to the ink ribbon 41, and reading the mark with a sensor Se2 described later.

Further, the sensor Se2 also detects the passage of the Bk panel, and position management inside each ribbon panel is performed by detection of the Bk panel, and is used for ribbon feeding and the like described later. More specifically, position management inside Y (Yellow), M (Magenta) and C (Cyan) between Bk (Black) and next Bk (Black) is performed by detecting a rotation amount of the supply spool 43 from an Off edge of Bk (Black) for the backside (by detecting the rotation amount of the spool with an encoder 121 described later). In this Embodiment, since there are no marks indicating boundaries between Y (Yellow) and M (Magenta) and between M (Magenta) and C (Cyan), the Off edge (Bk rear end) of Bk (Black) is judged as a start position (front end of Y) of Y (Yellow), and by relative position management from this point, the boundary (front end of M) between Y (Yellow) and M (Magenta) and the boundary (front end of C) between M (Magenta) and C (Cyan) are judged.

Furthermore, since a gap of about 3 mm is formed between Bk (Black) for the frontside and Bk (Black) for the backside, it is also possible to detect an On edge (front end) of Bk for the backside, and it is thereby possible to feed the Bk (Black) for the backside. In this Embodiment, the encoder 121 described later detects the rotation amount of the supply 43, and by detecting the rotation amount of the supply spool 43 such that the ink ribbon 41 is transported a certain amount, the spool diameters of the supply spool 43 and/or wind-up spool 44 are detected to calculate a ribbon remaining amount. The information of the spool diameter is also used in ribbon feeding. Although the ribbon transport distance to feed Y, M, and C from the Off edge of the Bk (Black) panel is constant, the supply spool rotation amount to transport the constant distance is varied with the spool diameter, and therefore, the rotation amount of the supply spool 43 is controlled by always detecting the spool diameter.

A platen roller 45 and thermal head 40 form the first transfer section, and the thermal head 40 is disposed in a position opposed to the platen roller 45. The thermal head 40 is heated and controlled by a head control IC (not shown) according to image data, and an image is printed on the transfer film 46 using the sublimation ink ribbon 41. In addition, a cooling fan 39 is to cool the thermal head 40.

The ink ribbon 41 with which printing on the transfer film 46 is finished is peeled off from the transfer film 46 with a peeling roller 25 and peeling member 28. The peeling member 28 is fixed to the cassette 42, the peeling roller 25 comes into contact with the peeling member 28 in printing, and the roller 25 and member 28 nip the transfer film 46 and ink ribbon 41 to peel. Then, the peeled ink ribbon 41 is wound around the wind-up spool 44 by driving the motor Mr1, and the transfer film 46 is transported to the second transfer section including a platen roller 31 and heat roller 33 by the film transport roller 49.

In the second transfer section, the transfer film 46 is nipped together with the card by the heat roller 33 and platen roller 31, and the image on the transfer film 46 is transferred to the card surface. In addition, the heat roller 33 is attached to an up-and-down mechanism (not shown) so as to come into contact with and separate from the platen roller 31 via the transfer film 46.

Figure 3:
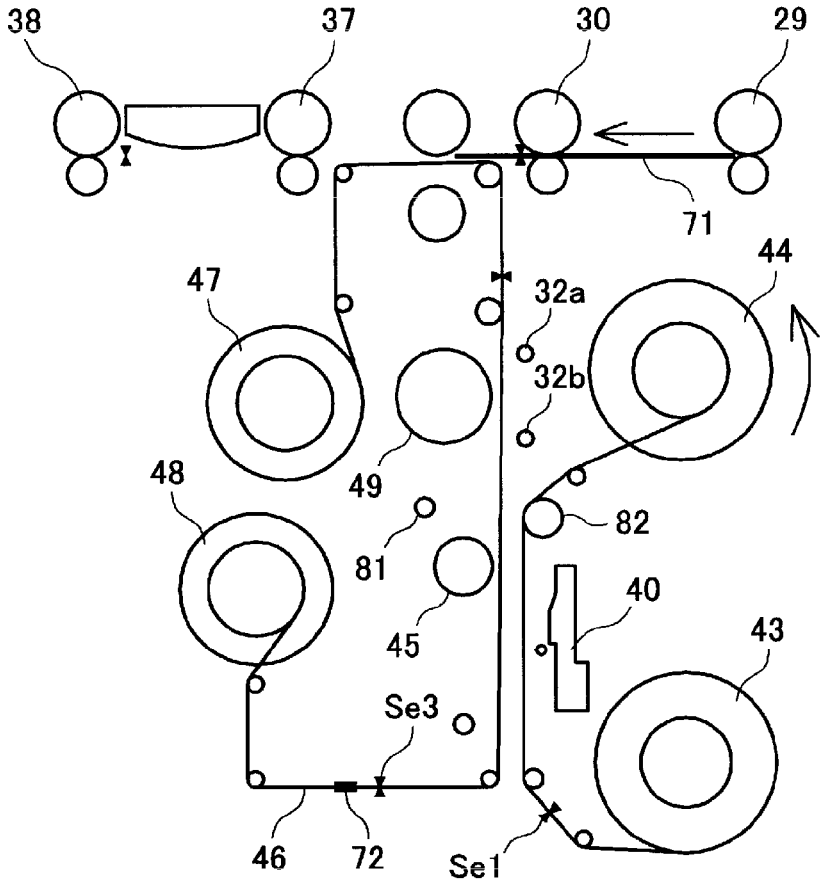
FIG. 3 is an operation explanatory view to explain a state of a waiting position in the printing apparatus.
Figure 4:
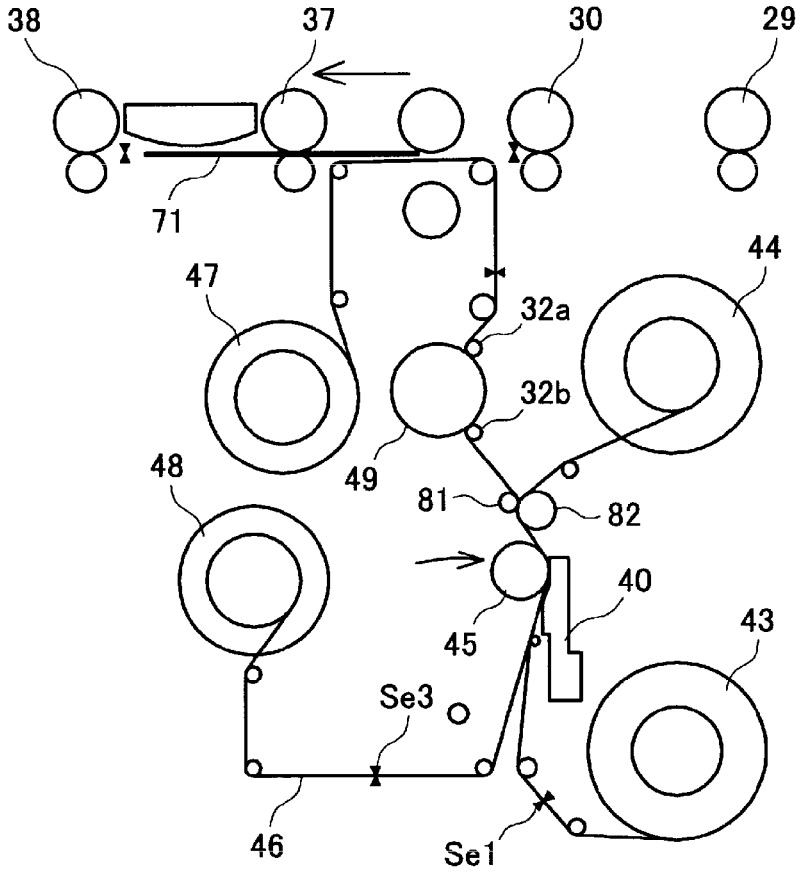
FIG. 4 is an operation explanatory view to explain a transport position in the printing apparatus.
Figure 5:
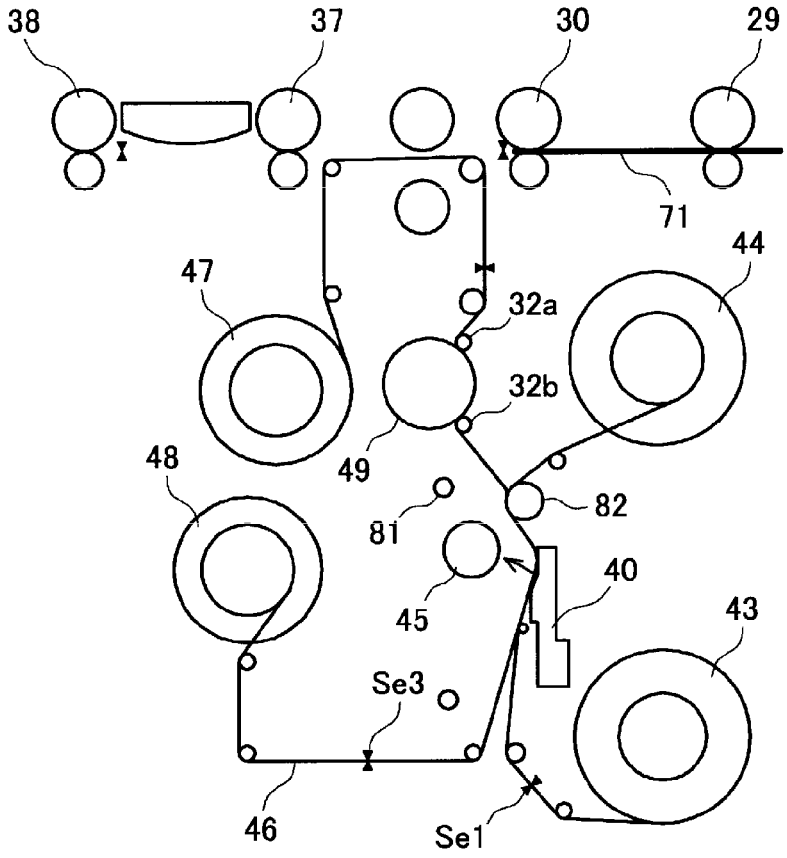
FIG. 5 is an operation explanatory view of a printing position in the printing apparatus.

As shown in FIGS. 3, 4 and 5, a tension receiving member 52A that receives tension from the platen roller 45, peeling roller 25 and transfer film 46 is able to shift to a waiting position separated from the transfer film 46, a printing position in press-contact with the thermal head 40 and the peeling member 28 via the transfer film 46 and the ink ribbon 41, and a film transport position between the waiting position and the printing position in which the platen roller 45 is separated from the thermal head 40.

Further, the pinch rollers 32*a*, 32*b* and tension receiving member 52 are configured to be able to contact and separate from the film transport roller 49. In addition, the platen roller 45, peeling roller 25, tension receiving members 52, 52A, and pinch rollers 32*a*, 32*b* are driven with a cam not shown.

In the waiting position as shown in FIG. 3, the pinch rollers 32*a*, 32*b* are not in press-contact with the film transport roller 49, and the platen roller 45 is not in press-contact with the thermal head 40.

Then, upon receiving a printing command, the image formation section B shifts to the printing position as shown in FIG. 4. At this point, the pinch rollers 32*a*, 32*b* first wind the transfer film 46 around the film transport roller 49, and concurrently, the tension receiving member 52 comes into contact with the transfer film 46. Subsequently, the platen roller 45 comes into press-contact with the thermal head 40. In this printing position, the platen roller 45 shifts toward the thermal head 40 to nip the transfer film 46 and ink ribbon 41 and come into press-contact, and the peeling roller 25 is in contact with the peeling member 28.

In this state, when transport of the transfer film 46 is started by rotation of the film transport roller 49, at the same time, the ink ribbon 41 is also wound around the wind-up spool 44 by operation of the motor Mr1 and transported in the same direction. During this transport, a positioning mark provided in the transfer film 46 passes through the sensor Se and shifts a predetermined amount, and at the time the transfer film 46 arrives at a printing start position, printing by the thermal head 40 is performed on the predetermined region of the transfer film 46. Particularly, since the tension of the transfer film 46 is large during printing, the tension of the transfer film 46 acts on the direction for separating the pinch rollers 32*a*, 32*b* from the film transport roller 49 and the direction for separating the peeling roller 25 and platen roller 45 from the peeling member 28 and thermal head 40. However, as described above, since the tension of the transfer film 46 is received in the tension receiving members 52, 52A, the press-contact forces of the pinch rollers 32*a*, 32*b* are not decreased, it is thereby possible to perform accurate film transport, the press-contact force of the thermal head 40 and platen roller 45 and the press-contract force of the peeling member 28 and peeling roller 25 are not decreased either, and it is possible to perform accurate printing and peeling. The ink ribbon 41 with which printing is finished is peeled off from the transfer film 46 and wound around the wind-up spool 44.

A shift amount by transport of the transfer film 46 i.e. a length in the transport direction of the printing region to undergo printing is detected by an encoder (not shown) provided in the film transport roller 49, rotation of the film transport roller 49 is halted corresponding to detection, and at the same time, winding by the wind-up spool 44 by operation of the motor Mr2 is also halted. By this means, finished is printing of the first color on the printing region of the transfer film 46 with the thermal head 40.

Subsequently, the image formation section B shifts to the transport position as shown in FIG. 5, and the platen roller 45 returns to the direction of retracting from the thermal head 40. In this state, the pinch rollers 32*a*, 32*b* still wind the transfer film 46 around the film transport roller 49, the tension receiving member 52 is in contact with the transfer film 46, and the transfer film 46 is transported backward to an initial position by rotation in the backward direction of the film transport roller 49. Also at this point, the shift amount of the transfer film 46 is controlled by rotation of the film transport roller 49, and the transfer film 46 is transported backward corresponding to the length in the transport direction of the printing region subjected to printing. In addition, the ink ribbon 41 is rewound a predetermined amount with the motor Mr3, and the panel of the color to print next waits in the initial position (feeding position).

Then, the section B is again in the printing position as shown in FIG. 4, the platen roller 45 is brought into press-contact with the thermal head 40, and when the film transport roller 49 rotates again in the forward direction to shift the transfer film 46 corresponding to the length of the printing region, printing with the next color is performed with the thermal head 40.

Thus, the operation in the printing position and the transport position is repeated until printing of all colors (in this example, four colors of Y (Yellow), M (Magenta), C (Cyan) and Bk (Black) in the case of the frontside. One color of Bk (Black) in the case of the backside) is finished. Then, when printing (first transfer) with the thermal head 40 is finished, the first transferred region of the transfer film 46 is transported to the heat roller 33, and at this point, the press-contact of the pinch rollers 32*a*, 32*b* with the transfer film 46 is released. In subsequent second transfer, by driving the wind-up roll 47, transfer to the card is performed while transporting the transfer film. In second transfer, by bringing the transfer film 46 and the card into press-contact with the heat roller 33 and the platen roller 31 and heating, the image formed on the transfer film 46 is transferred to the card.

<Ink Ribbon Cassette>

Figure 6:
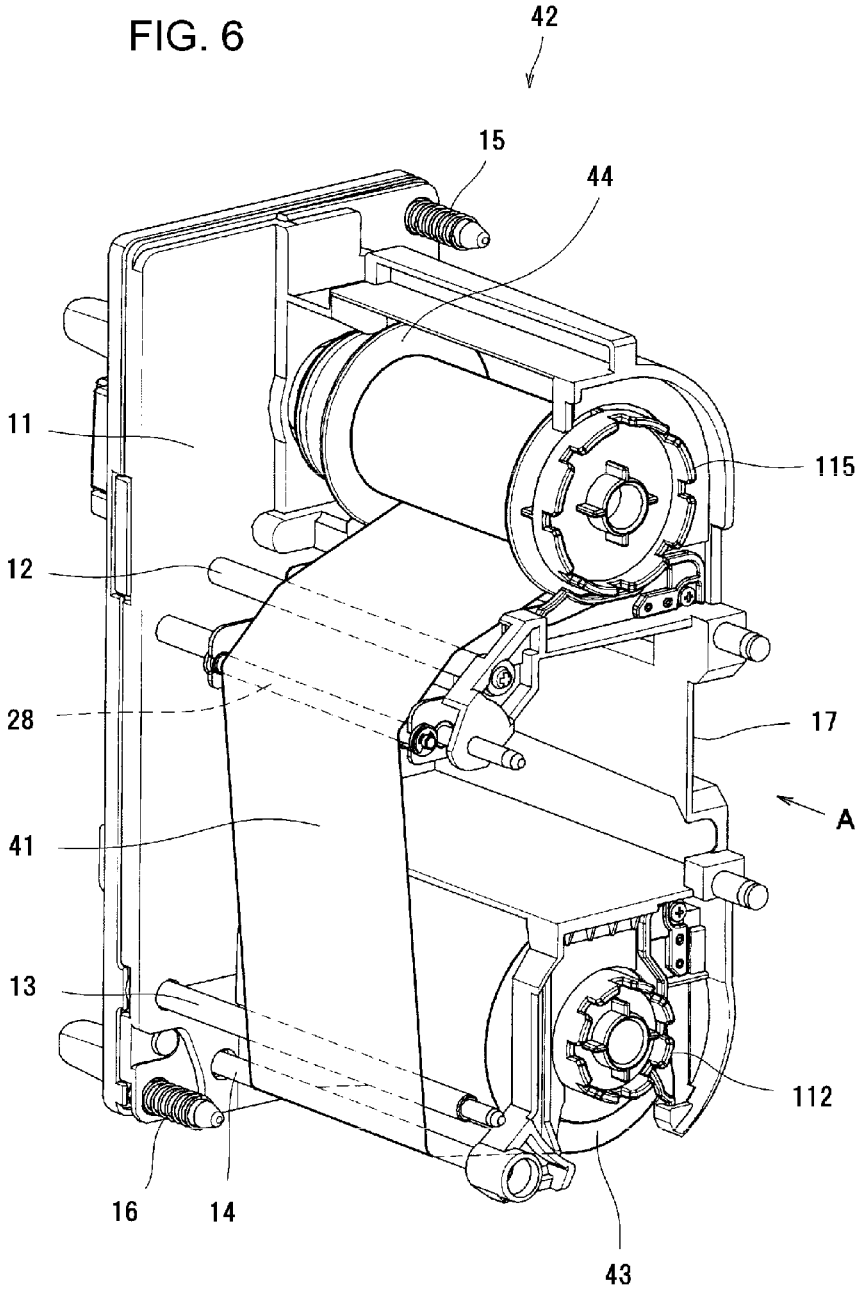
FIG. 6 is an outside perspective view of a ribbon cassette.

The cassette 42 storing the ink ribbon 41 will specifically be described next. As shown in FIG. 6, the cassette 42 has a base 11 in the shape of a rectangular plate that is a base bench of the cassette 42. Main-body connection protrusions 15, 16 to insert in the main-body apparatus (printing apparatus 1) protrude in the base 11. Springs are wound around the main-body insertion protrusions 15, 16, and by the springs, the cassette is slidably inserted in the main-body apparatus.

The wind-up spool 44 is disposed rotatably on one side (upper side in FIG. 6) in the longitudinal direction of the base 11, and the supply spool 43 is disposed rotatably on the other side (lower side in FIG. 6) in the longitudinal direction of the base 11. In other words, on one side and the other side in the longitudinal direction of the base 11 are formed circular through holes for axially supporting shafts (see reference numeral "119" in FIG. 7) on one side of the wind-up spool 44 and supply spool 43 rotatably, respectively. The wind-up spool 44 has an engagement portion 115 with a large diameter on the other side of the shaft, and the supply spool 43 has an engagement portion 112 with a diameter smaller than that of the engagement portion 115 on the other side of the shaft 119. The reason why the diameters are thus different between the engagement portion 115 and the engagement portion 112 is to prevent erroneous insertion in the vertical direction shown in FIG. 6 in inserting the cassette 42 in the main-body apparatus.

Further, the cassette 42 has a cover 17 that covers the wind-up spool 44 and the supply spool 43 in the direction crossing the base 11. The cover 17 is fixed to the end portion along the longitudinal direction of the base 11. Further, from the lower side to upper side in FIG. 6, in the cassette 42 are disposed shafts 14, 13, shaft-shaped peeling member 28, and shaft 12 to be parallel with the shaft line of the supply spool 43 or wind-up spool 44. These shafts are fixed on one side to the base 11, while being fixed on the other side to extension portions extending to be opposed to the base 11 from the cover 17.

Accordingly, the ink ribbon 41 fed out of the supply spool 43 is transported to come into slide-contact on one surface side with the shafts 14, 13, peeling member 28 and shaft 12 to be wound around the wind-up spool 44, or inversely, to come into slide-contact with the shaft 12, peeling member 28 and shafts 14, 13 to be wound around the supply spool 43.

Figure 10A:
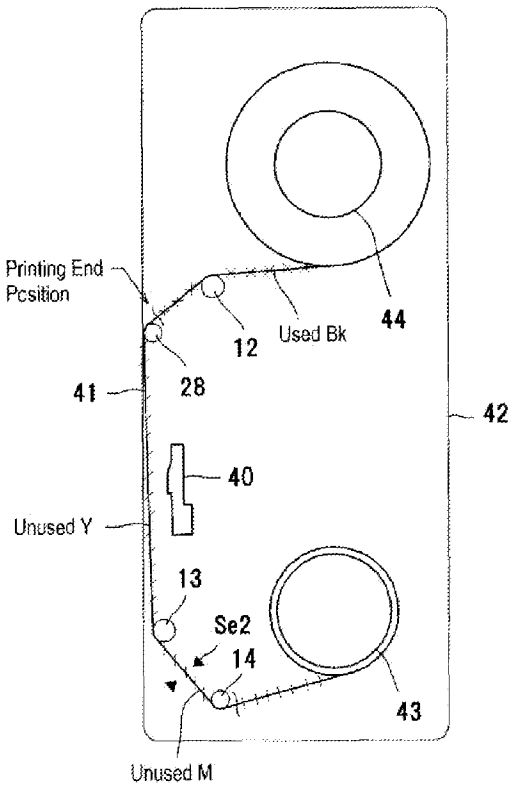

Described herein is the arrangement relationship between the sensor Set and thermal head 40 on the main-body side and the shafts when the cassette 42 is inserted in the main-body apparatus. As shown in FIG. 10A, the sensor Se2 is positioned in between the shaft 14 and the shaft 13 along the ink ribbon 41 fed out of the supply spool 43, and the thermal head 40 is positioned in between the shaft 13 and the peeling member 28.

Described further is the relationship among the ink ribbon 41, supply spool 43, wind-up spool 44 and the like when the cassette 42 is inserted in the main-body apparatus. The length of the ink ribbon 41 laid between the supply spool 43 and the wind-up spool 44 is set to be shorter than the total length of three ribbon panels among ribbon panels of successive four colors of Y (Yellow), M (Magenta), C (Cyan) and Bk (Black), and further, along the ink ribbon 41 laid between the supply spool 43 and the wind-up spool 44, each of the distance between the supply spool 43 and the sensor Se2, the distance between the sensor Se2 and the thermal head 40, the distance between the thermal head 40 and the peeling member 28, and the distance between the peeling member 28 and the wind-up spool 44 is set to be shorter than the length of a ribbon panel of one color of the ink ribbon 41.

<Engagement of the Spool Main Body and Main-Body Apparatus>

Figure 7:
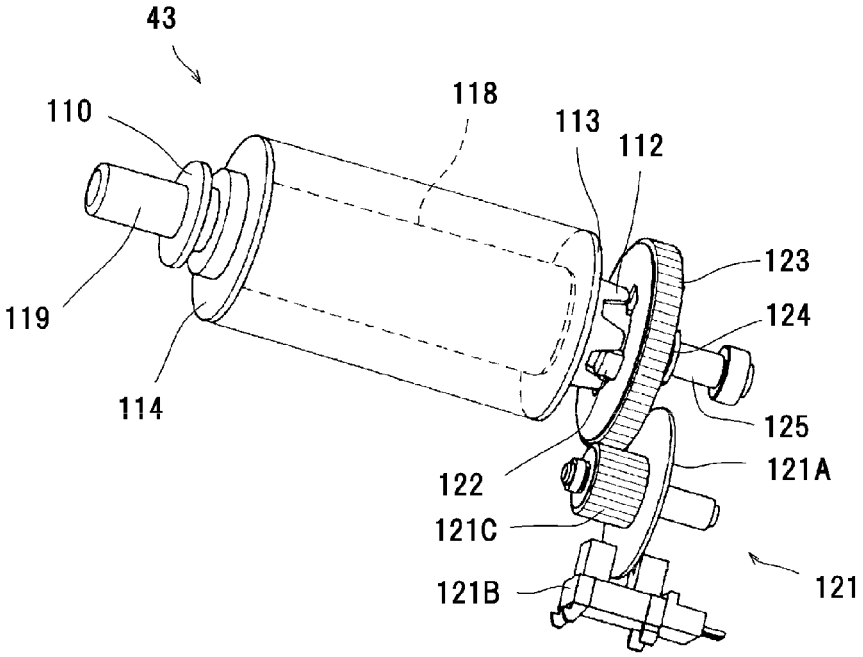
FIG. 7 is a perspective view showing an engagement state of a supply spool and the main body side.

With reference to FIG. 7, described next are a spool main body 110 on the supply spool 43 side and an engagement portion of the printing apparatus 1 to engage in the spool main body 110. FIG. 7 shows an engagement state of the engagement portion 112 of the supply spool 43 and an engagement member (engagement convex portion 122) on the main-body apparatus side. An engagement state of the engagement portion of the wind-up spool 44 and an engagement member on the main-body apparatus is the same, the supply spool 43 is therefore only described, and the description on the wind-up spool 44 is omitted. The engagement portion 112 has eight rectangular convex portions protruding in the direction of the end portion. In addition, in the supply spool 43 and wind-up spool 44 shown in FIG. 6, the ink ribbon 41 is wound around (held by) the respective spool main body 110, an unused portion of the ink ribbon 41 is wound around the supply spool 43, and a used portion of the ink ribbon 41 (ink ribbon 41 subjected to thermal transfer with the thermal head 40) is wound around the wind-up spool 44.

The spool main body 110 has a cylindrical ribbon holding portion 118 having fringes 113, 114 at opposite ends to hold the ink ribbon 41, the engagement portion 112 provided on one end portion adjacent to the fringe 113, and a shaft portion 119 with a diameter smaller than that of the cylindrical portion of the ribbon holding portion 118 provided on the side opposite to the engagement portion 112 adjacent to the fringe 114.

The fringes 113, 114 regulate the position of winding of the ink ribbon 41 around the ribbon holding portion 118 in the shaft direction of the spool main body 110. Therefore, when the spool main body 110 rotates, an unused ink ribbon 41 is supplied from the ribbon holding portion 118 without causing misregistration (in the case of the supply spool 43), and a used portion of the ink ribbon 41 is properly wound around the ribbon holding portion on the wind-up side (in the case of the wind-up spool 44).

The engagement portion on the main-body apparatus side associated with the engagement portion 112 of the supply spool 43 is comprised of a plurality of members. In other words, a support shaft 125 is fixed to the housing 2, and axially supports the disk-shaped engagement member having a gear on the outer edge portion to be rotatable. On the side engaging in the engagement portion 112 of the engagement member, two engagement convex portions 122 of shapes different from the convex portion (groove portion) of the engagement portion 112 are provided to protrude opposite each other (so as to make a phase difference of 180° with respect to the rotation direction of the engagement portion). In the engagement portion 122 is formed a groove formed from an inclined surface linearly formed on the convex-portion side surface having a predetermined inclined angle, and a bottom portion connecting between adjacent convex-portion inclined surfaces (in FIG. 7, the relationship between the engagement portion 112 and the convex portion of the engagement portion 112 is inverse.) Further, a spring 124 is wound around the support shaft 125, and by this spring 124, the engagement portion (engagement convex portions 122) is biased to the engagement portion side slidably. In addition, a gear 123 meshes with a gear not shown, and the driving force is transferred from the motor Mr3 to the gear that is not shown.

In inserting the cassette 42 in the main-body apparatus, there is the case that the front end of the convex portion of the engagement portion 112 of the spool main body 110 comes into contact with (hits) the front end of the engagement convex portion 122 provided in the engagement member on the apparatus main body side, and is not inserted smoothly. Since the engagement member is provided slidably in the shaft direction of the support shaft 125, when the front ends of the convex portions of the engagement portion 112 hit the front ends of the engagement convex portions 122, the engagement convex portions 122 once retract to the apparatus frame side (on the side opposite to the spool main body 110). Subsequently, when the engagement member or spool main body 110 rotates, the engagement convex portions 122 enter into the groove between convex portions of the engagement portion 112, and are biased to the spool main body 110 side by the spring 124, and the engagement convex portions 122 and the (groove between) convex portions of the engagement portion 112 come into point-contact in two points.

The gear of the engagement member meshes with a gear 121C, and to the gear 121C is fixed a rotating plate 121A with a slit (not shown) formed on the same axis. Further, in a position to sandwich the rotating plate 121A is disposed a transmission integral-type sensor 121B comprised of a light emitting device and a light receiving device. Accordingly, the rotating plate 121A and sensor 121B constitute the encoder 121 as a rotation amount detecting device for detecting a rotation amount of the supply spool 43 that supplies the ink ribbon 41. In addition, an encoder (not shown) provided in the above-mentioned film transport roller 49 is configured in the same way. In other words, a gear that is the same as the gear 123 shown in FIG. 7 is fitted into the drive shaft of the film transport roller 49, the encoder has a gear (that corresponds to the gear 121C in FIG. 7) meshing with the gear and a rotating plate (that corresponds to the rotating plate 121A in FIG. 7), and it is configured that rotation of the rotating plate is capable of being detected with a sensor (that corresponds to the sensor 121B in FIG. 7).

With the printing processing on the transfer film 46 with the thermal head 40, the ink ribbon 41 is transported from the supply spool 43 side to the wind-up spool 44, and according to transport, the ribbon diameter of the supply spool 43 shifts from the large diameter to the small diameter, while the ribbon diameter of the wind-up spool 44 changes from the small diameter to the large diameter. With the change, the tension in winding the ink ribbon 41 around the wind-up spool 44 shifts from high to low, and inversely, the tension in rewinding the ink ribbon 41 around the supply spool 43 shifts from low to high. Therefore, in this example, used are two motors of the motor Mr1 that is the rotation drive source of the wind-up spool 44 and motor Mr3 that is the rotation drive source of the supply spool 43, and by also using a velocity difference between these two motors, the tension of the ink ribbon 41 is adjusted. For example, in winding the ink ribbon 41 around the wind-up spool 44, the rotation velocity of the motor Mr3 is set to be slightly lower than the rotation velocity of the motor Mr1 to apply the back tension so that the ink ribbon 41 does not sag. In addition, it is assumed that forward rotation drive is the case of rotating the motors Mr1 and Mr3 in the direction in which the ink ribbon 41 is wound around the wind-up spool 44, and that backward rotation drive is the case of rotating the motors Mr1 and Mr3 in the direction in which the ink ribbon 41 is rewound around the supply spool 43.

Described next is control and electric system of the printing apparatus 1. As shown in FIG. 8, the printing apparatus 1 has a control section 100 that performs operation control of the entire printing apparatus 1, and a power supply section 120 that transforms utility AC power supply into DC power supply that enables each mechanism section, the control section and the like to be driven and actuated.

<Control Section>

As shown in FIG. 8, the control section 100 is provided with a microcomputer 102 that performs entire control processing of the printing apparatus 1. The microcomputer 102 is comprised of a CPU that operates at fast clock as the central processing unit, ROM in which is stored basic control operation (programs and program data) of the printing apparatus 1, RAM that works as a work area of the CPU, and internal buses that connect the components.

The microcomputer 102 is connected to an external bus. The external bus is connected to an interface, not shown, to communicate with the higher apparatus 201, and buffer memory 101 to temporarily store printing data to print on the card, recording data to magnetically or electrically record in a magnetic stripe portion or built-in IC of the card, and the like.

Further, the external bus is connected to a sensor control section 103 that controls signals from various sensors, an actuator control section 104 that controls motor drivers and the like for outputting drive pulses and drive power to respective motors, a thermal head control section 105 to control thermal energy to heater elements constituting the thermal head 40, an operation display control section 106 to control the operation panel section 5, and the above-mentioned information recording section A.

The power supply section 120 supplies operation/drive power to the control section 100, thermal head 40, operation panel section 5 and information recording section A.

(Operation)

The printing processing operation of the printing apparatus 1 of this Embodiment will be described next with the CPU (hereinafter, simply referred to as CPU) of the microcomputer 102 focused. In addition, since the entire operation of the printing apparatus 1 has been already described, the description herein will be given with emphasis on a determining flow of the printing order on the card by the CPU.

First, in the printing system 200 of this Embodiment, since it is possible to print on both surfaces of the card, user generates printing data with the higher apparatus 201 such as a PC. For example, since the ink ribbon 41 used in the apparatus is to print colors and Black (Y, M, C, Bk) (referred to as colors) on the frontside of the card, and to print Black (Bk) on the backside, the user generates printing data for the frontside and printing data for the backside. At this point, there is not any problem in the case of always printing colors on the frontside, and printing Black on the backside. However, in the case of printing Black on the frontside, and colors on the backside during the time of issuing a plurality of cards, printing is started with the monochrome ribbon panel 41*b* for the backside while passing the color ribbon panel 41*a* for the frontside, and then, an image to print on the backside of the card is printed with the next color ribbon panel 41*a* for the frontside. Accordingly, the previous color ribbon panel 41*a* is wasted.

Therefore, the printing apparatus 1 of this Embodiment is configured to compare the type (colors, or Black) of a ribbon panel of the next usable ink ribbon 41 with the printing data sent from the higher apparatus 201 to be able to change the printing order. Further, also in the case of using the YMCBk-Bk ink ribbon 41 as shown in FIG. 11A, when printing is performed using the same type of ribbon panels on the card both surfaces (for example, both-side colors or both-side black), either of the ribbon panels is wasted. In this case, when the printing order is changed corresponding to whether the frontside of the card is discharged up or the backside is discharged up in card discharge, the processing speed in the card issue is improved. For example, in the case of discharging the card with the backside up, when the backside undergoes transfer after the second transfer section performs frontside transfer, it is necessary to reverse the card again after backside transfer to discharge. Accordingly, the time taken for the reverse processing is reduced, by transferring to the backside first, then transferring to the frontside, and discharging without any processing.

In this Embodiment, the CPU of the microcomputer 102 compares the printing data received from the higher apparatus 201 with the type of a next usable ribbon panel to determine the printing order. More specific processing flow will be described below.

Figure 9:
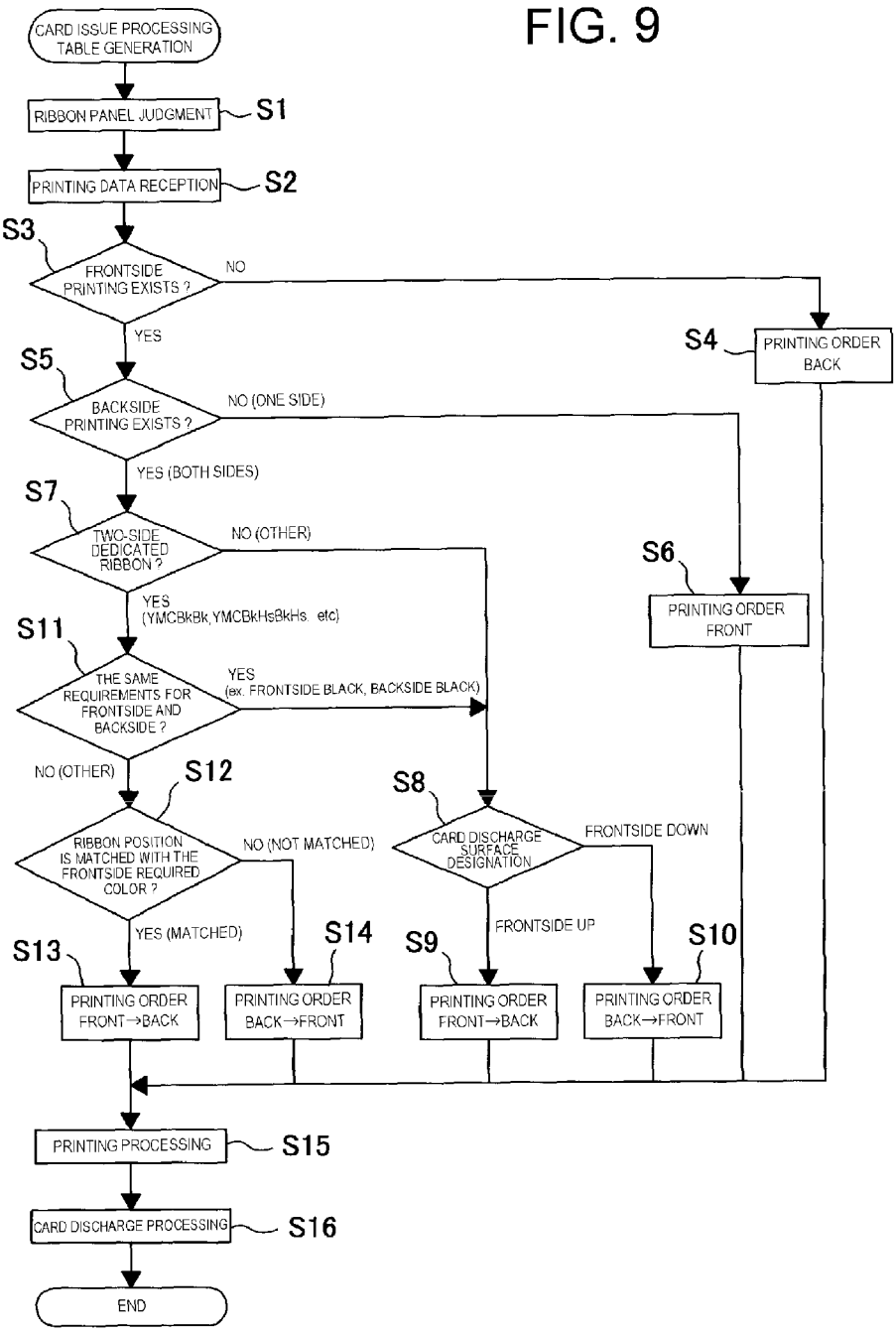
FIG. 9 is a flowchart of a printing order determining processing routine executed by a CPU of a microcomputer of the control section of the printing apparatus of the Embodiment.

As shown in the flowchart of FIG. 9, in step S1, the CPU judges the type of a next usable ribbon panel. The current ribbon position is determined by detection of the passage of the Bk (Black) panel by the sensor Se and detection of the rotation amount of the supply spool 43 by the encoder as described above, and therefore, it is possible to judge whether the next usable ribbon panel is the color ribbon panel 41*a* or the monochrome ribbon panel 41*b*.

Then, in step S2, the CPU receives printing data from the higher apparatus. First, it is judged whether or not the printing data has frontside printing data (step S3). When there is only backside printing data without frontside printing data, one-side printing is judged, and the printing order is "only backside" (step S4). Further, when there is only frontside without backside printing data (step S5), one-side printing is judged, and the printing order is "only frontside" (step S6). Thus, in the case of only the frontside or only the backside, the type of a ribbon panel to use is determined by the printing data, and printing is performed using the color ribbon panel 41*a* for color data, while being performed using the monochrome ribbon panel 41*b* for monochrome data.

Next, it is judged whether the ink ribbon 41 set in the printing apparatus 1 is the two-side dedicated ribbon (step S7). The ink ribbon 41 used in this Embodiment is the two-side dedicated ribbon of Y, M, C, Bk: Bk, and in the case of the ink ribbon (FIG. 11B) in which the ribbon panel of four colors of Y, M, C, Bk is configured in a face sequential manner, it is not necessary to change the printing order corresponding to the printing data. In this case, the printing order is changed corresponding to the direction of the card discharge surface (step S8). Accordingly, in the case that setting is made to discharge the frontside up, the printing order is "front→back" (step S9). In the case that setting is made to discharge the backside up, the printing order is "back→front" (step S10).

In step S7, when it is judged that the set ink ribbon 41 is the two-side dedicated ribbon, the frontside printing data is compared with the backside printing data to judge whether or not to use the same type of ribbon panels for the frontside and backside (step S11). For example, when color data is printed on both surfaces in a state in which the two-side dedicated ribbon is set, it is not necessary to change the printing order corresponding to the printing data, and therefore, in this, the CPU shifts to step S8 to determine the printing order corresponding to the direction of the card discharge surface.

In step S11, when it is judged that the type of the printing data is different between the frontside and the backside, the CPU compares the type of the next usable ribbon panel judged in step S1 with the type (color or monochrome) of the frontside printing data to judge whether or not the types are matched (step S12). For example, in the case where the type of the next usable ribbon panel is the color ribbon panel 41*a* and the frontside data is also color data, the ribbon panel is not wasted when printing is performed in the order of front (color)→back (monochrome), and the printing order is set at "front→back" (step S13). On the other hand, in the case where the type of the next usable ribbon panel is the color ribbon panel 41*a* and the frontside printing data is monochrome data, when printing is performed in the order of front (monochrome)→back (color), the frontside monochrome data is printed while passing the next usable color ribbon panel 41*a*, and the color ribbon panel 41*a* is wasted. Accordingly, in this case, the printing order is set at "back→front" (step S14).

According to thus set printing order, the first transfer section performs printing processing on the transfer film 46, and the second transfer section performs transfer processing on the first surface of the card. Subsequently, in the case of two-side printing, the card is reversed, and the transfer processing is performed on the second surface (step S15). The card subjected to the transfer processing is discharged to the storage section D (step S16). In addition, when the printing order set corresponding to the type of the ribbon panel and the type of the printing data is different from the printing order set corresponding to the direction of the card discharge surface, it is possible to set to allow the user to select the order to give priority. When priority is given to the printing order set corresponding to the type of the ribbon panel and the type of the printing data, the card reversing processing is performed again after performing the transfer processing on card both surfaces, and the card is discharged to the storage section D.

As described above, in this Embodiment, the printing order is determined by comparing the type of the next usable (nearest) ribbon panel from the position of the current ink ribbon 41 with the type (color data or monochrome data) of the printing data received from the higher apparatus 201, and it is thereby possible to reduce waste of the ribbon panel. Further, when waste of the ribbon panel does not occur due to the printing data (when the set ink ribbon is not a two-side dedicated ribbon, or the frontside printing data and the backside printing data has the same type), it is possible to set the printing order corresponding to the direction of the chard discharge surface, and the processing time is thereby shortened.

The setting of the printing order corresponding to the direction of the card discharge surface as described above is to resolve the following problem. By changing the printing order corresponding to whether to make the discharge surface of the printing medium (card) face-up discharge or face-down discharge, there is the effect of reducing the processing time in discharging the printing medium. For example, in the case of a printing apparatus for performing printing processing on the printing medium from below, in discharging the backside of the printing medium up, it is necessary to perform frontside transfer→reverse then backside transfer→further reverse then discharge, and the reverse operation may increase. In this case, by changing the printing order to backside→frontside, the need of reverse operation after printing is eliminated, and it is possible to shorten the processing time.

Figure 12:
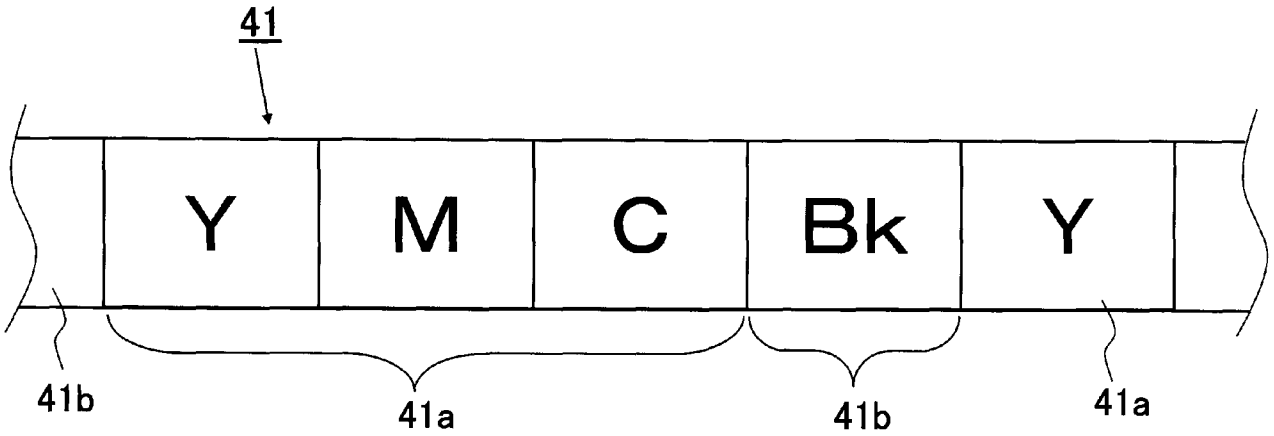
FIG. 12 is a view illustrating an ink ribbon used in the printing asparagus of the Embodiment, and shows an example of using the ink ribbon shown in FIG. 11B as a two-side dedicated ribbon.

However, in the case of changing the printing order on both surfaces of the printing medium, there is the problem as described below. For example, in the printing apparatus using the ink ribbon in Patent Document 1 (Japanese Unexamined Patent Publication No. 2008-207375) as described above, in the case of using the two-side dedicated ribbon comprised of different types of ribbon panels (for example, color ribbon panel 41*a* and black ribbon panel 41*b*) respectively for the frontside and backside of the printing medium as shown in FIGS. 11A and 12, when the printing order is changed by giving priority to the processing speed in discharging the printing medium, there is a possibility that printing is performed while passing either the color ribbon panel 41*a* or monochrome ribbon panel 41*b*, and there is a risk that the ribbon panel is wasted.

To resolve the above-mentioned problem, as described above, in this Embodiment, it is a feature that the printing apparatus, which performs printing processing directly or indirectly on a printing medium using a first ink ribbon in which a first ribbon panel of a single color or a plurality of colors and a second ribbon panel of a type different from the first ribbon panel are continuously arranged and the first ribbon panel and the second ribbon panel are arranged in a face sequential manner, or a second ink ribbon in which the same type of ribbon panels are arranged in a face sequential manner to print on both surfaces of the printing medium having a first surface and a second surface, is provided with a printing section that forms an image directly or indirectly on the printing medium, a ribbon type judging device for judging whether the ink ribbon is the first ink ribbon or the second ink ribbon, a printing data judging device for judging whether to use the same type of ribbon panels for the first surface and the second surface of the printing medium from printing data, a discharge surface setting device for setting to discharge the first surface of the printing medium up or to discharge the second surface up, and a printing order determining device for determining the printing order of the first surface and the second surface of the printing medium, and that when the ribbon type judging device judges that the second ink ribbon is used, or the printing data judging device judges that the same type of ribbon panels are used for the first surface and the second surface of the printing medium, the printing order determining device determines the printing order on the printing medium corresponding to setting information by the discharge surface setting device.

The apparatus is further provided with a detecting device for detecting a panel position of each ribbon panel of the ink ribbon, an use panel judging device for judging whether a next usable nearest ribbon panel is the first ribbon panel or the second ribbon panel, and a printing data judging device for judging whether data to print is printed using the first ribbon panel or is printed using the second ribbon panel, and when the ribbon type judging device judges that the first ink ribbon is used and the printing data judging device judges that the different types of ribbon panels are used for the first surface and the second surface of the printing medium, the printing order determining device compares the type of the next usable nearest ribbon panel judged by the use panel judging device with the type of the ribbon panel judged by the printing data judging device to determine the printing order on the printing medium.

Further, a printing method in this Embodiment is a printing method for performing printing processing on a printing medium using a first ink ribbon in which a first ribbon panel of a single color or a plurality of colors and a second ribbon panel of a type different from the first ribbon panel are continuously arranged and the first ribbon panel and the second ribbon panel are arranged in a face sequential manner, or a second ink ribbon in which the same type of ribbon panels are arranged in a face sequential manner to print on both surfaces of the printing medium having a first surface and a second surface, and is characterized in that it is judged whether the ink ribbon is the first ribbon or the second ink ribbon, it is judged whether the same type of ribbon panels are used for the first surface and the second surface of the printing medium from printing data, discharging the first surface of the printing medium up or discharging the second surface up is set, and that when it is judged that the ink ribbon to use is the second ink ribbon, or it is judged that the same type of ribbon panels are used for the first surface and the second surface of the printing medium, the printing order on the first surface and the second surface of the printing medium is determined corresponding to setting information of the discharge surface of the printing medium to perform printing processing on both surfaces of the printing medium according to the determined printing order.

Furthermore, it is a feature that a panel position of each ribbon panel of the ink ribbon is detected, it is judged whether a next usable nearest ribbon panel is the first ribbon panel or the second ribbon panel, it is judged whether printing data is printed using the first ribbon panel or is printed using the second ribbon panel, and that when it is judged that the first ink ribbon is used and it is judged that the different types of ribbon panels are used for the first surface and the second surface of the printing medium, the type of the next usable nearest ribbon panel is compared with the type of the ribbon panel judged with the printing data to determine the printing order on the first surface and the second surface of the printing medium.

From the above-mentioned description, by judging the type of the ink ribbon, and the type of a ribbon panel to use from printing data, when the ribbon is not a two-side dedicated ribbon or printing is performed using the same type of ribbon panels on both surfaces of the printing medium, the printing order on the first surface and the second surface of the printing medium is determined corresponding to the discharge surface of the printing medium. Therefore, there is the effect of reducing the processing time in discharging the printing medium also in the printing apparatus using the ink ribbon.

In addition, this Embodiment shows the configuration in which the CPU of the microcomputer 102 determines the printing order, and information of the next usable ink ribbon may be transmitted to the higher apparatus 201 so that the higher apparatus 201 side determines the printing order and transmits a printing command to the printing apparatus 1 according to the determined printing order. Further, the type information of the ink ribbon 41 and setting information of the card discharge surface that is set may be similarly transmitted to the higher apparatus 201 to determine the printing order on the higher apparatus 201 side.

Further, this Embodiment shows the example of the intermediate transfer type printer in which the first transfer section forms an image on the transfer film 46 with the ink ribbon 41 and the second transfer section transfers the image to the card, and a direct transfer type printer may be used in which the thermal head 40 and platen roller 45 bring the ink ribbon 41 and the card into press-contact to directly print on the card.

Figure 11B:
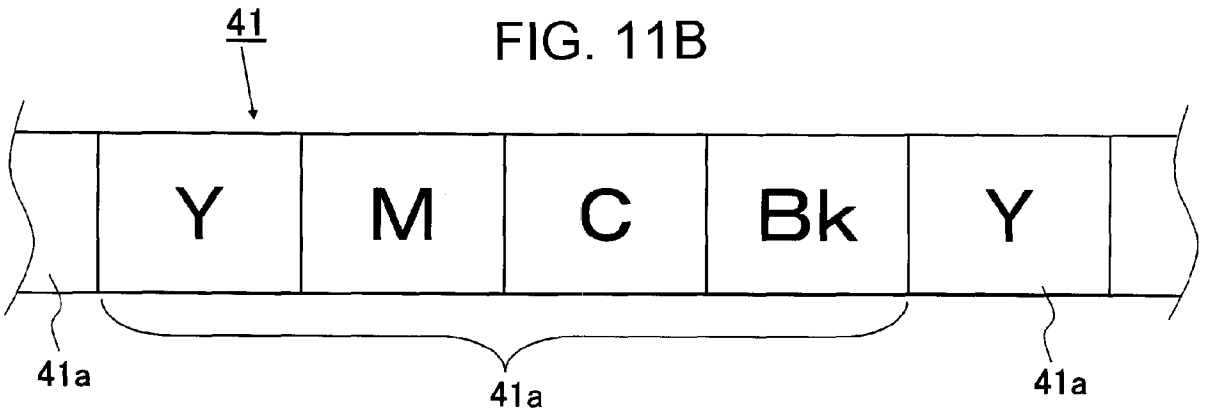

In addition, this Embodiment shows the example in which the ink ribbon 41 with ribbon panels of four colors of Y, M, C and Bk configured in a face sequential manner as shown in FIG. 11B is not handled as the two-side dedicated ribbon, but color printing may be performed on the frontside of the card using three colors of Y, M and C, while performing monochrome printing on the backside with Bk. In other words, generally, the ink ribbon 41 of Y, M, C and Bk is used to print on one surface of the card with four colors, and as shown in FIG. 12, the ink ribbon 41 may be set for a mode to use Y, M and C as the color ribbon panel (first ribbon panel) 41*a*, and Bk as the monochrome ribbon panel (second ribbon panel) 41*b*.

This mode setting may be made by a user operating the operation panel section 5 to set, or may be set from the higher apparatus 201 side. When this mode is set, since the ink ribbon 41 with Y, M, C and Bk configured in a face sequential manner is also judged as the two-side dedicated ribbon, the judgment in step S7 of the flowchart as shown in FIG. 9 is "yes" (the ribbon is a two-side dedicated ribbon)", and the subsequent flow is as described above (the same as in Y, M, C, Bk, Bk ribbon). From the above-mentioned description, the ink ribbon for enabling different types of colors (ink) to be printed respectively on the frontside and the backside of the card is capable of being used as the two-side dedicated ribbon, and control of the present invention is applicable thereto.

In addition, this application claims priority from Japanese Patent Application No. 2013-116846, Japanese Patent Application No. 2013-116847, and Japanese Patent Application No. 2014-102129 incorporated herein by reference.

The invention claimed is:

1. A printing apparatus which performs printing processing directly or indirectly on a printing medium using an ink ribbon in which a first ribbon panel of a single color or a plurality of colors and a second ribbon panel of a type different from the first ribbon panel are continuously arranged and the first ribbon panel and the second ribbon panel are arranged in a face sequential manner to print on both surfaces of the printing medium having a first surface and a second surface, comprising:

a printing section that forms an image directly or indirectly on the printing medium;

a detecting device for detecting a panel position of each ribbon panel of the ink ribbon;

an use panel judging device for judging whether a next usable nearest ribbon panel is the first ribbon panel or the second ribbon panel from a detection result by the detecting device;

a receiving section that receives printing data;

a printing data judging device for judging whether the printing data is printed using the first ribbon panel or is printed using the second ribbon panel; and a printing order determining device for determining a printing order on the first surface and the second surface of the printing medium, wherein the printing order determining device compares a type of the next usable nearest ribbon panel judged by the use panel judging device with a type of the ribbon panel judged by the printing data judging device to determine the printing order on the first surface and the second surface of the printing medium.

2. The printing apparatus according to claim 1, wherein when the type of the ink panel used for the first surface judged by the printing data judging device is matched with the type of the next usable nearest ink panel judged by the use panel judging device, the printing order determining device determines to first print on the first surface of the printing medium.

3. The printing apparatus according to claim 1, wherein the printing order determining device is configured to be able to further change the printing order corresponding to whether the first surface of the printing medium is discharged with the surface up or is discharged with the surface down, and when the printing data judging device judges that the same type of ink panels are used for the first surface and the second surface of the printing medium, determines the printing order corresponding to a discharge surface of the printing medium.

4. A printing method for performing printing processing directly or indirectly on a printing medium using an ink ribbon in which a first ribbon panel of a single color or a plurality of colors and a second ribbon panel of a type different from the first ribbon panel are continuously arranged and the first ribbon panel and the second ribbon panel are arranged in a face sequential manner to print on both surfaces of the printing medium having a first surface and a second surface, wherein a panel position of each ribbon panel of the ink ribbon is detected to judge whether a next usable nearest ribbon panel is the first ribbon panel or the second ribbon panel, it is judged whether printing data is printed using the first ribbon panel or is printed using the second ribbon panel, a type of the next usable nearest ribbon panel is compared with a type of the ribbon panel judged with the printing data to determine a printing order on the first surface and the second surface of the printing medium, and printing processing is performed on both surfaces of the printing medium according to the determined printing order.

5. The printing method according to claim 4, wherein in determining the printing order, when the type of the ink panel used for the first surface of the printing medium is matched with the type of the next usable nearest ribbon panel, the printing order is determined so as to first print on the first surface of the printing medium.

6. The printing method according to claim 4, wherein discharging the first surface of the printing medium up or discharging the second surface up is set, and when it is judged that the same type of ink panels are used for the first surface and the second surface of the printing medium, the printing order is determined corresponding to information of a set discharge surface.

* * * * *